United States Patent [19]

Kime

[11] Patent Number: 4,666,375

[45] Date of Patent: May 19, 1987

[54] PUMPING SYSTEM

[76] Inventor: James A. Kime, 5360 Godown Rd., Columbus, Ohio 43220

[21] Appl. No.: 733,127

[22] Filed: May 10, 1985

[51] Int. Cl.[4] ..... E21B 43/00

[52] U.S. Cl. ..... 417/46; 417/401; 166/53; 166/68.5

[58] Field of Search ..... 166/53, 68.5; 417/401, 417/403, 404, 46; 60/372, 374

[56] References Cited

U.S. PATENT DOCUMENTS

| | | | |
|---|---|---|---|
| 828,680 | 8/1906 | Quick | 166/68.5 X |
| 1,754,946 | 4/1930 | Haskell | 166/53 |
| 2,081,220 | 5/1937 | Coberly | 417/404 |
| 2,770,197 | 11/1956 | Deitrickson | 417/46 |
| 3,212,406 | 10/1965 | NcDuffie | 166/68.5 |
| 4,369,839 | 1/1983 | Freeman et al. | 166/53 |
| 4,403,919 | 9/1983 | Stanton et al. | 417/404 X |

*Primary Examiner*—Carlton R. Croyle
*Assistant Examiner*—Theodore Olds
*Attorney, Agent, or Firm*—Mueller and Smith

[57] ABSTRACT

Pump system, method and apparatus for detecting a well pump off condition and for operating a well with cycles of alternate short pumping operation and outgassing operation to substantially reduce well pump off.

13 Claims, 11 Drawing Figures

PUMPING SYSTEM

BACKGROUND OF THE INVENTION

The production of crude oil from a formation involves a broad range of techniques and equipment. One such production technique is that of using a "down hole" pump submerged in a well containing formation fluid which is reciprocatively driven to lift the fluid through a tubing string to the well head from where it is piped to separation and storage facilities. Classically, a walking beam and more recently an improved hydraulic stroking device at the surface reciprocates the pump.

In a gas driven formation the formation fluid generally includes a mixture of water, oil, free gas and gas which has been forced into solution by formation pressure. As pumping of the well occurs, formation pressure may be reduced. Because of this reduced pressure, the flow rate of formation fluid into the well may become less than the rate at which the down hole pump can remove the fluid from the well. Consequently, eventually the hydrostatic head of the formation fluid in the well may fall to where a substantial quantity of the gas in solution is outgassed as the formation fluid enters the pump. This outgassed fluid may form a sizable pocket which gas locks the pump, i.e., the gas pocket cannot be compressed to the extent it can be pumped up the tubing string and the pressure in the pump cannot be lowered to a state wherein more fluid can be drawn into the pump to displace the gas pocket. When this occurs the well has become pumped off. A gas locked pump remains in that locked state until additional formation fluid flows into the well and the hydrostatic head of that fluid becomes sufficient to cause the fluid to enter the pump and displace the pocket of gas therein.

Traditionally, operators of wells wherein the pump apparatus can displace fluid more rapidly than formation fluid flows into the well have operated these apparatuses with alternate on-off cycles. For example, during a 24 hour period a pump apparatus may be operated for 4–8 hours and then shut down for the remainder of the period to permit the hydrostatic head of the formation fluid to build back up to where more fluid can be pumped. In many instances the wells become pumped off, i.e., pumps become gas locked, before the end of their operating periods because most operators time their pump apparatuses to run until liquid is no longer exhausted at the well head. It has been found that operating a pump in a gas locked state, in addition to being inefficient because no fluid is being pumped, causes excessive pump and seal wear and causes paraffin to deposit on the walls of the tubing string which may ultimately block the flow of fluid up that string. The occurrence of pump off in a well will be lessened if the flow of formation fluid into the well can be increased. It has been found that such flow can be increased if the back pressure in the well can be reduced. Thus, ideally a pump apparatus should be operated such that the hydrostatic head of the formation fluid will be kept as low as possible without gas locking the pump. Most conventional walking beam pumps cannot be operated in a manner such that the hydrostatic head of the formation fluid is kept at a minimum because it cannot be determined when they are gas locked. The occurrence of gas lock has been found to be reduced if the down hole pump is capable of pumping fluid having an low hydrostatc head and of outgassing small pockets of gas in the pumping chamber as shown in Applicant's copending U.S. patent application Ser. No. 732,850, filed May 10, 1985.

Although the flow of formation fluid into the well will be enhanced by a reduced back pressure in the well such a reduced pressure becomes undesirable during the pumping operation. During this operation a high back pressure becomes advantageous because it prevents outgassing of dissolved gases when formation fluid enters the pump. Thus, a high back pressure enables the pump to operate on fluid having a low hydrostatic head.

In view of the foregoing, it will be appreciated that the pumping efficiency of a gas-oil well which may become pumped off during the pumping operation will be enhanced greatly if a pumped off condition can be detected and a gas locked condition of the pump avoided and if the back pressure in the well can be reduced to increase the flow of formation fluid into the well without causing the pump to gas lock.

SUMMARY OF THE INVENTION

The present invention is addressed to method, system and apparatus for detecting pump off of a gas oil well and for increasing the flow of formation fluid into the well to reduce the occurrence of pump off. Where a hydraulic stroking device is utilized to reciprocate a down hole pump through a rod string, a pumped off condition of the well can be detected by changes in the load on the rod string. A control is used to deactivate the stroking device when the well is pumped off. Increased flow of formation fluid into the well is achieved by subjecting the well to cycles of alternate short periods of pumping and outgassing.

An additional feature of the invention is the provision of a gas-oil well production system in which a down hole pump is operated by a hydraulic stroking unit to lift formation fluid in a well casing through a tubing string. A means for activating the hydraulic stroking unit for a first period of time is provided. A barrel in fluid communication with the tubing string having a barrel fluid inlet and a barrel chamber is also provided. A plunger reciprocates within said barrel chamber. A rod string is provided which connects the plunger with the hydraulic stroking unit.

Means are provided for supplying working fluid to the activated hydraulic stroking unit at a first pressure to raise the stoking unit and thereby move the plunger from a lower terminal position to an upper terminal position.

Further means are provided for removing the working fluid at a controlled rate from the activated hydraulic stroking unit to permit the weight of the rod string and plunger to lower the hydraulic stroking unit and thereby cause the rod string and barrel chamber, respectively, until the plunger to be lowered in the tubing string and the plunger is at the lower terminal position.

Also, means are provided for sensing the pressure of the working fluid in the hydraulic stroking unit as the plunger is lowered and when the plunger is at a predetermined position in the barrel chamber to determine whether the weight of the fluid column in the tubing string is being supported by the rod string and plunger at the predetermined position. Also provided is a means for deactivating the hydraulic stroking unit for a second period of time.

Another feature of the invention is to provide a short cycle gas-oil well production system in which alternately a down hole pump is operated by a hydraulic stroking unit to lift formation fluid in a well casing through a tubing string and an outgassing device is operated to lower the pressure in the well casing. A barrel is provided in fluid communication with the tubing string having a barrel fluid inlet and a barrel chamber. A plunger is mounted for reciprocation with the barrel chamber. A rod string connects the plunger with the hydraulic stroking unit.

Means are provided for activating the hydraulic stroking unit for a first time period. Additional means are provided for supplying working fluid to the activated hydraulic stroking unit at a first pressure to raise the stroking unit and thereby move the plunger form the lower terminal position to the upper terminal position.

Further means are provided for removing the working fluid at a controlled rate from the activated hydraulic stroking unit to permit the weight of the rod string and the plunger to lower the hydraulic stroking unit and thereby cause the rod string and plunger to be lowered in tubing string and barrel chamber, respectively, until the plunger is at lower terminal positions. Means are provided for outgassing gas in the well, this means being in fluid communication with the well casing. Additional means are provided for activating the outgassing means for a second period of time.

Other features of the invention will, in part, be obvious and will, in part, appear hereinafter.

The invention, accordingly, comprises the apparatus, method, and system processing the construction, combinations of elements and steps, and arrangement of parts, which are exemplified in the following detailed description. For a fuller understanding of the nature and features of the invention, reference should be had to the following detailed description taken in conjunction with the accompanying drawings.

DETAILED DESCRIPTION OF THE INVENTION

Figure 1:
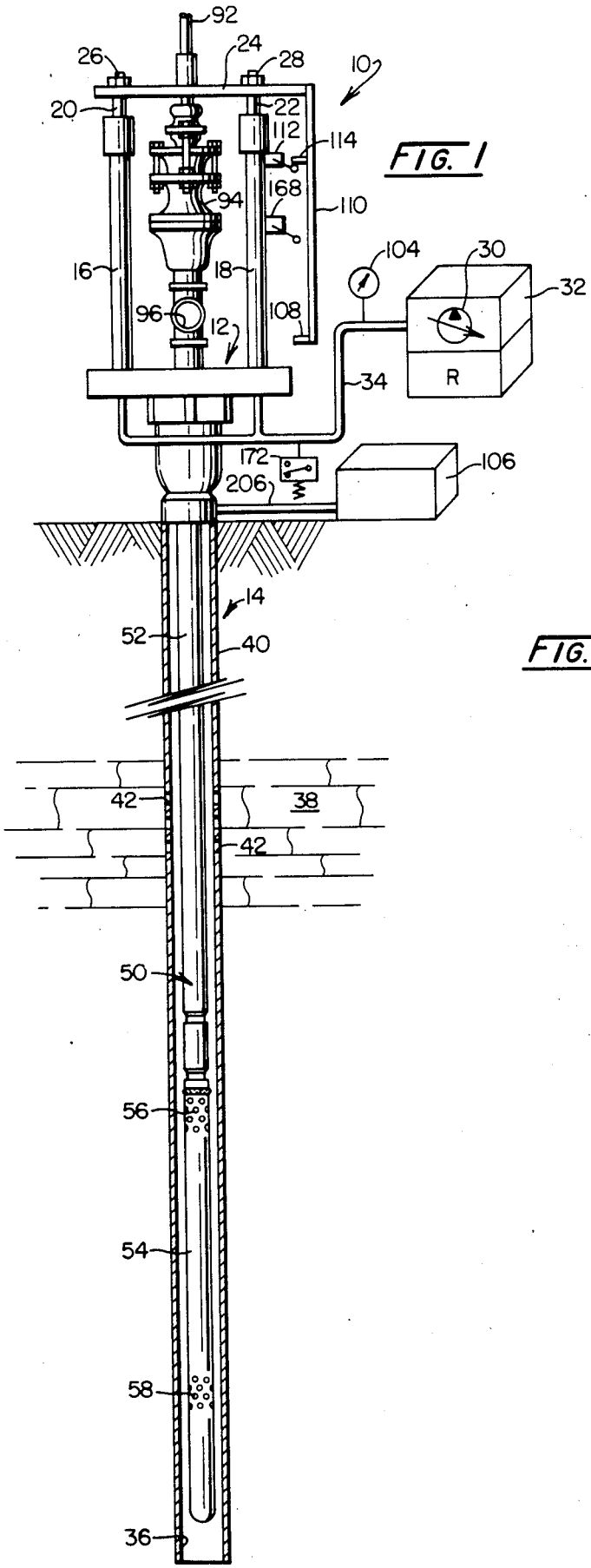
FIG. 1 is a partial sectional view illustrating the outgassing device and pump off detection system of the instant invention connected to a well and to a surface stroking device.

The apparatus and method of the instant invention are used in conjunction with a hydraulic stroking device which operates a down hole pump in a well drilled into a gas driven formation which lacks sufficient pressure to drive the formation fluid to the well head. An overall picture of the operating environment of the hydraulic stroking device with an outgassing device and the pump off detection system of the invention is shown in FIG. 1. A portion of a hydraulic stroking device 10 is mounted adjacent a well head 12 which provides surface control of a well 14. Stroking device 10 includes two hydraulic cylinders 16 and 18 which have extensible and retractable piston rods 20 and 22, respectively. These cylinders 16 and 18 are connected in a drive arrangement by a horizontally extending yoke plate 24 which is attached to the outer ends 26 and 28 of piston rods 20 and 22. Piston rods 20 and 22 and yoke plate 24 are raised when hydraulic working pressure fluid from a variable displacement, cross center pump 30 contained within enclosure 32 is supplied to one end of cylinders 16 and 18 through a conduit 34. This serves to extend the piston rods 20 and 22. The piston rods and yoke plate 24 are lowered when the pump 30 is reversed and working pressure fluid is removed from the one end of cylinders 16 and 18 at a controlled rate to permit the piston rods 20 and 22 to be retracted into the cylinders 16 and 18 by the weight of the rod string acting on yoke plate 24.

Well 14 (broken away and enlarged to show a pump apparatus at the bottom of the well) includes a hole 36 drilled in the terrestrial surface to a depth below the upper level of a formation 38. As an example, the Clinton formation in Northeastern United States exhibits this formation at depths between 2800 and 5500 feet. A casing 40 is inserted in hole 36 to provide a rigid side wall for well 14. Openings 42 are formed in the lower portion of casing 40 by conventional methods, i.e., controlled explosion to permit formation fluid to flow into well 14. This fluid rises to a level at which the hydrostatic pressure of the fluid column plus the pressure of any gases above the fluid column equals formation pressure, that being the pressure exerted on the fluid in the formation by natural gas or water. In a well drilled into a gas driven formation, the formation fluid is a complex mixture of oil, water, free gas, and dissolved gases termed "light ends". These light ends constitute the volatile fractions of the formation. They are maintained in solution in the mixture because of formation pressure if the mixture is in the formation or because of the hydrostatic pressure of the fluid column if the mixture is in the well 14.

Production apparatus is installed in well 14 as is represented generally at 50. This apparatus 50 comprises a tubing string 52 which includes a plurality of tubular sections which are successively coupled together by threaded connections to provide a fluid conduit for pumped fluid. The upper end of the tubing string 52 is secured to well head 12 through a conventional arrangement of hangers and seals. A mud anchor 54 is connected to the lower portion of tubing string 52. Mud anchor 54 is seen to be located at the bottom of well 14 below the openings 42 in casing 40 which admit formation fluid. Anchor 54 is submerged in the fluid. Two groups of bores depicted generally at 56 and 58 are drilled in the side wall of mud anchor 54. Formation fluid enters mud anchor 54 through both bore groupings 56 and 58.

Figure 2:
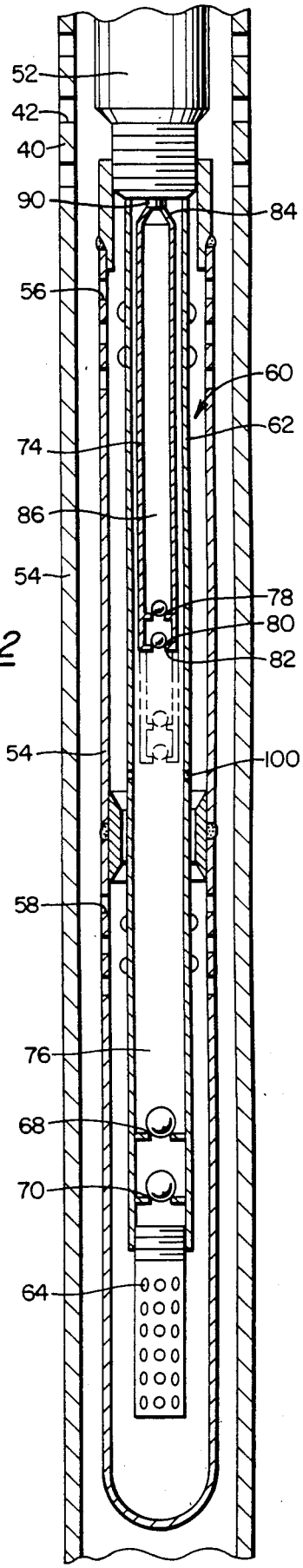
FIG. 2 is an enlarged sectional view of the well portion of FIG. 1 showing the down hole pump.

Positioned within mud anchor 54 is a long, narrow down hole pump 60 which may be seen in detail by referring to FIG. 2. Down hole pump 60 includes a long, slender, tubular barrel 62 which is rigidly connected to and in fluid communication with the lower end of tubing string 52. A barrel fluid inlet 64 is provided at the lower end of barrel 62 to enable formation fluid inside of mud anchor 54 to enter pump 60. Two standing ball and seat check valves 68 and 70 are mounted in series at the lower end of barrel 62 above fluid inlet 64. Such ball and seat check valve combinations allow fluid to flow through the valve when there is a pressure differential across it such that the fluid pressure acting on the seat and bottom of the ball is greater than the fluid pressure acting on the top of the ball. Down hole pump 60 further includes a long, slender, tubular plunger 74 which is confined within a barrel chamber 76 formed by the side walls of barrel 72. A pair of travelling ball and seat check valves 78 and 80 are mounted in the lower end of plunger 74 above a fluid inlet 82. Fluid outlets 84 are located at the upper end of plunger 74 to provide fluid communication between a plunger fluid chamber 86 and tubing string 52. Plunger 74 is reciprocally driven within barrel chamber 76 by hydraulic stroking device 10. Reciprocal drive communication between device 10 at the well head 12 and plunger 74 is provided by an elongated rod string 90. Such a rod string is made up of an assembly of long, slender metal rods, which are successively coupled together by threaded connections. The uppermost component of rod string 90, termed a "polish rod", is revealed in FIG. 1 at 92. Such a rod 92 has a machined outer surface and an upper end which projects upwardly through a stuffing box 94 mounted in well head 12 and is connected in driven relationship with yoke plate 24. Consequently, as hydraulic stroking device 10 operates to reciprocate yoke plate 24, rod string 90 simultaneously reciprocates pump plunger 74 within barrel chamber 76 to pump formation fluid through tubing string 52 to well head 12. The pumped fluid which reaches the surface of well 14 will exit well head 12 through a conduit 96 which is connected to a collection system, not shown, that provides the conventional functions of oil, gas, and water separation and storage.

Owing to the dynamics of pump action, movement of yoke plate 24 does not instantaneously cause corresponding movement of pump plunger 74. For the most part, a significant lag in pump reaction occurs. This is due to the fact that, as plunger 74 moves upwardly in barrel chamber 76, it lifts the fluid column in tubing string 52 and rod string 90 is stressed by the weight of that column. Therefore, rod string 90 exhibits strain (stretch) which must be accommodated by movement of yoke plate 24 before plunger 74 can commence to move. Similarly, when plunger 74 moves downwardly in barrel chamber 76, the weight of the fluid column in tubing string 52 is transferred from the rod string 90 to the tubing string 52. This causes the rod string 90 to recover or contract. Therefore, the distance rod string 90 contracts must be accommodated by downward movement of yoke plate 24 before plunger 74 begins to move.

After well 14 has been pumped for a period of time, formation pressure will begin to fall and the fluid column in casing 40 gradually will lower until, unless corrective procedures are undertaken, the well 14 ultimately will be pumped off. As the fluid column in casing 40 lowers, hydrostatic pressure concomitantly is reduced. Consequently, when this fluid mixture enters pump 60 and the pressure is further reduced by the pumping action, some of the light ends are outgassed. These light ends may combine with free gas in the mixture to form a gas pocket. Looking to FIG. 2, a pair of ports 100 may be seen to be formed in the side wall of barrel chamber 76 somewhat below the bottom of plunger 74 when the plunger is at its upper terminal position. Consequently, as plunger 74 moves downwardly in chamber 76 from the upper terminal position shown in solid lines to the position represented by phantom lines fluid in barrel 62 is exhausted through ports 100. Thus, a method is provided for removing small gas pockets which may enter the pumping chamber formed between the bottom of plunger 74 and standing check valves 68 and 70 of down hole pump 60. This prevents gas lock caused by small pockets of gas. However, if formation pressure and hydrostatic pressure in well 14 become too low, the fluid mixture which enters pump 60 will contain little or no liquid and a large gas pocket will form in barrel chamber 76 which cannot be accommodated or removed through ports 100. When this occurs, pump 60 is gas locked, i.e., the gas pocket cannot be compressed to the extent it can be pumped up the tubing string and the pressure in the pump cannot be lowered to a state wherein more fluid can be drawn into the pump to displace the gas pocket and the well 14 is pumped off.

With the method and apparatus of this invention, a pumped off condition of the well can be detected instantaneously and the pump 60 deactivated in order to prevent undesirable pump wear and paraffin build-up in tubing string 52. Additionally, an outgassing device 106 is provided which participates in a unique production cycle of alternate short periods of pumping and outgassing. Such outgassing reduces the back pressure in casing 40 to promote the flow of formation fluid into the casing and thereby reduce the possibility of the well 14 becoming pumped off but permits the back pressure to increase during pumping operation. In consequence of the utilization of a hydraulic stroking device as at 10 to operate down hole pump 60, the operation of the latter 60 can be examined to determine if well 14 is pumped off. This is achieved by observing the changes load on rod string 90 which occur during a pump operating cycle. Because piston rods 20 and 22 and yoke plate 24 support rod string 90, the load on the rod string will be reflected by the pressure of the working fluid in the cylinders 16 and 18. Thus, the load changes on rod string 90 may be evaluated by observing the readings of a pressure gauge 104 mounted to monitor the fluid pressure in fluid conduit 34, the latter supplying and removing working pressure fluid from hydraulic cylinders 16 and 18 as described in connection with FIG. 1. It should be noted that the readings of gauge 104 will provide a relative indication of the load on rod string 90 since the actual load will be the pressure multiplied by the area of the pistons in cylinders 16 and 18.

Changes in the load on rod string 90 may be observed by referring to FIGS. 3A through 3F which represent successive conditions during one operating cycle of down hole pump 60. The elements of hydraulic stroking device 10, well 14, and down hole pump 60 which are shown diagrammatically in FIGS. 3A through 3F are identified by the numerals used to functionally identify those same elements in FIGS. 1 and 2. An upper scale which indicates the inches of travel of piston rods 16 and 18 and yoke 24 and a lower scale which indicates the inches of travel of plunger 74 is provided in each of the FIGS. 3A through 3F. Additionally, a diagram of pressure verses the displacement of yoke plate 24 is also provided in each figure. The travel distances and the pressures shown in the figures are typical for a stroking device having a pair cylinders with 1.5 inch diameter pistons and driving a down hole pump in the Clinton formation. The start of an upstroke is depicted in FIG.

3A. At this position plunger 74 and yoke 24 are both at their lower terminal positions. In this orientation, standing ball and seat check valves 68 and 70 and traveling ball and seat check valves 78 and 80 are closed and the column of fluid in tubing string 52 is supported by the standing ball valves 68 and 70 and tubing string 52. Though there is no displacement of yoke plate 24, a minor increase in the pressure of the working fluid occurs. This represents the frictional forces exerted on rod string 90 from the side walls of tubing string 52 and stuffing box 94. This pressure increase is shown as A-B on the pressure-displacement diagram.

Figure 3A:
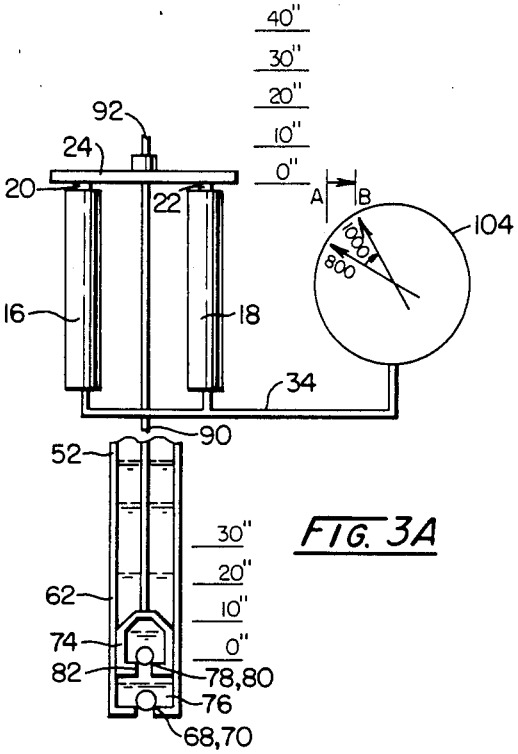
FIGS. 3A–3F are diagrammatical illustrations of the changes in pressure which occur in the lift cylinders of the hydraulic stroking unit during one operating cycle of the down hole pump.
Figure 3B:
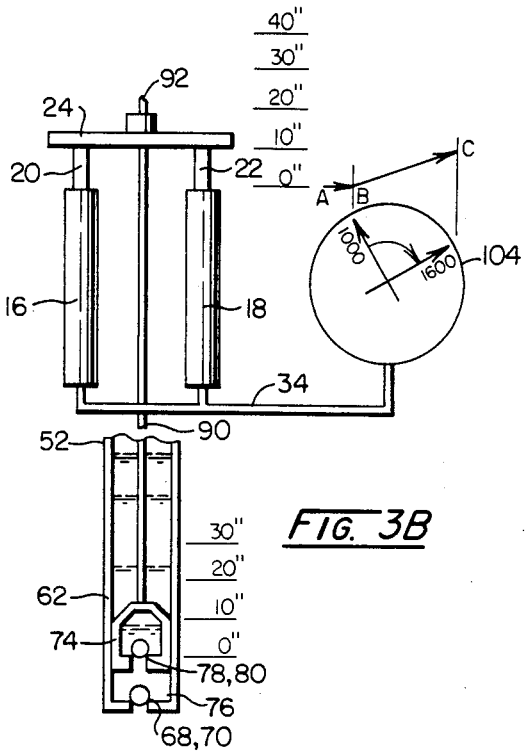

It may be recalled, that owing to the dynamics of pump action, movement of yoke plate 24 does not instantaneously cause corresponding movement of pump plunger 74. In fact, a lag in pump reaction occurs. This lag is illustrated in FIG. 3B in which the weight of the fluid column in tubing string 52 is shown transferred to rod string 90. Although yoke plate 24 is seen to have moved upward 10 inches, plunger 74 has remains stationary. This illustrates the strain rod string 90 must accommodate when the weight of the fluid column in tubing string 52 is transferred from the tubing string to rod string 90. The strain or stretch of rod string 90 occurs as the working fluid pressure increases to that required to lift the rod string 90 and the fluid column. This pressure change is indicated between points B and C on the pressure-displacement diagram.

Figure 3C:
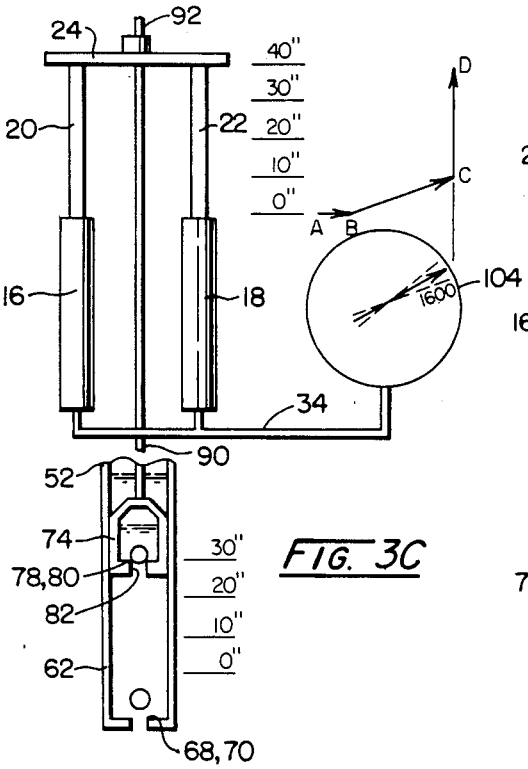

FIG. 3C represents the upward movement of yoke plate 24 and plunger 74 after the working pressure is sufficient to enable the yoke plate to lift the rod string and the fluid column. During this time yoke plate 24 moves 30 inches and rod string 90 and plunger 74 also move 30 inches. The pressure of the working fluid supplied to cylinders 16 and 18 remains constant as yoke plate 24 and plunger 74 are lifted as seen between points C-D in the pressure-displacement diagram. During this time, it may be observed that standing ball and seat check valves 68 and 70 are open and formation fluid flows into barrel chamber 76 beneath plunger 74.

Returning momentarily to FIG. 1, when yoke plate 24 and plunger 74 reach their upper terminal positions a cam 108 on a traveling rod 110 affixed to yoke plate 24 engages a limit switch 112 and moves it to its alternate operating position. Limit switch 112 operates a servo valve which moves the control of the cross center variable displacement pump 30 across center to reverse the pump and thereby remove working pressure fluid from hydraulic cylinders 16 and 18 at a controlled rate. This enables pistons 20 and 22 and yoke plate 24 to move downwardly under the weight of rod string 90. At this time the fluid column load is transferred to the tubing string 52.

Figure 3D:
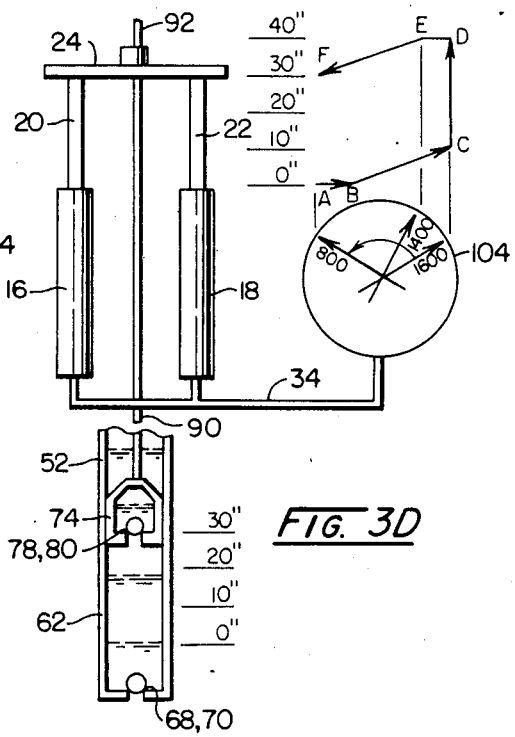

Looking to FIG. 3D, the change in working fluid pressure which occurs when the weight of the fluid column is transferred from the rod string 90 to tube string 52 may be observed. Yoke plate 24 is seen to have moved downwardly 10 inches while plunger 30 remains stationary. Standing ball and seat check valves 68 and 70 are closed. During the downward movement of yoke plate 24, the pressure of the working fluid 18 initially drops a small amount represented between points D and E on the pressure displacement diagram. A larger subsequent drop of much larger amount is represented between points E and F on the diagram. The former, small pressure change represents the reversal of the drag forces from the stuffing box 94 and the rod string 90 dragging in tubing string 52, while the latter, larger pressure change represents the transfer of the weight of the fluid column from the rod string 90 to the tubing string 52. Subsequent to the transfer of the fluid column load to the tubing string, the rod string load is at a minimum. It should be noted that the immediate large pressure drop from point E to point F, which represents the transfer of the weight of the fluid column occurs because barrel chamber 76 beneath plunger 74 is filled with liquid.

Figure 3E:
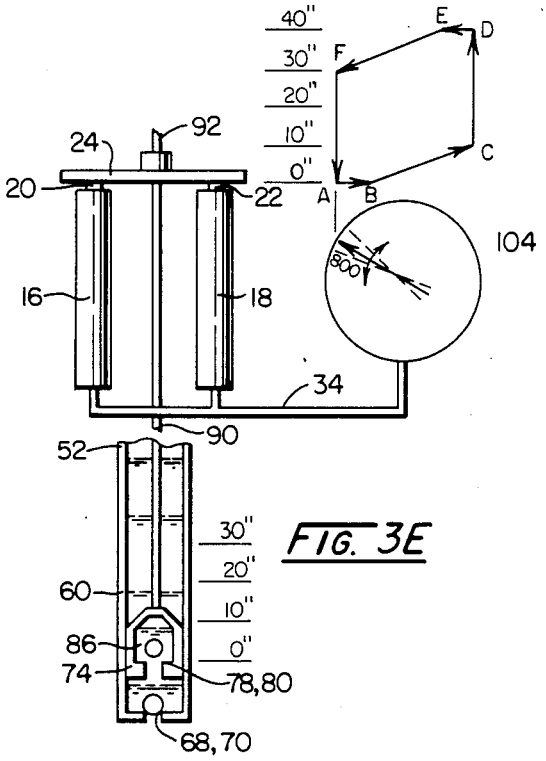

As yoke plate 24, rod string 90, and plunger 74 move downwardly toward their lower terminal position the pressure in hydraulic cylinders 16 and 18 remains constant, as shown by the vertical line between points F and A in FIG. 3E. As plunger 74 moves downwardly, traveling ball and seat check valves 78 and 80 are open and standing ball and seat check valves 68 and 70 are closed. This enables the fluid to move upwardly into plunger chamber 86. Again referring to FIG. 1, as yoke plate 24 and plunger 74 reach their lower terminal positions, cam 114 on traveling rod 110 moves limit switch 112 to its alternate operating position which causes a valve to move the pump control across center to thereby cause working pressure fluid to be supplied to hydraulic cylinders 16 and 18 to initiate a new cycle.

Figure 3F:
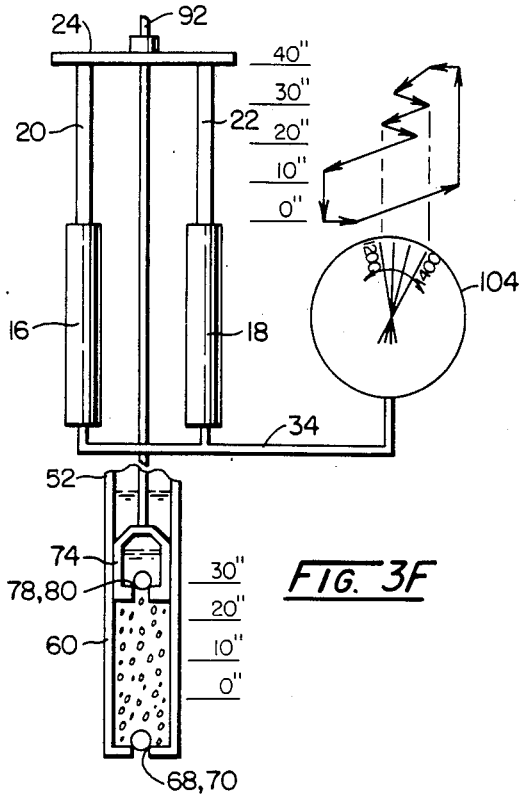

The effect of a pumped off condition of well 14 on the function of down hole pump 60 may be observed by referring to FIG. 3F. It may be recalled that, when well 14 is pumped off, a significant gas pocket is formed in barrel chamber 76 which gas locks the down hole pump 60. Consequently, when yoke plate 24 begins to move downwardly from its upper terminal position, rod string 90 and plunger 74 also begin to move downwardly from their upper terminal position. There is no lag in the movement of plunger 74 due to rod contraction. This is because there is no liquid beneath plunger 74 which will support the weight of the fluid column in tubing string 52. Consequently, the weight of the fluid column remains on rod string 90 and the pressure of the working pressure fluid in hydraulic cylinders 16 and 18 does not drop to the low level indicated between points F and A in FIG. 3E until plunger 74 is close to its lower terminal position if at all. From this, it should be apparent that a pumped off condition at well 14 can be detected if the pressure in hydraulic cylinders 16 and 18 fails to reach the normal minimum pressure encountered when the tubing string fluid column is supported by tubing string 52. It should be noted that, in the event the down hole pump 60 is equipped with degassing ports 100 as shown in FIG. 2 the minimum pressure of the working fluid in the hydraulic cylinders 16 and 18 will not occur until the plunger 74 has passed those ports. Normally, this will happen when yoke plate is about 15 inches below its upper terminal position.

Figure 4:
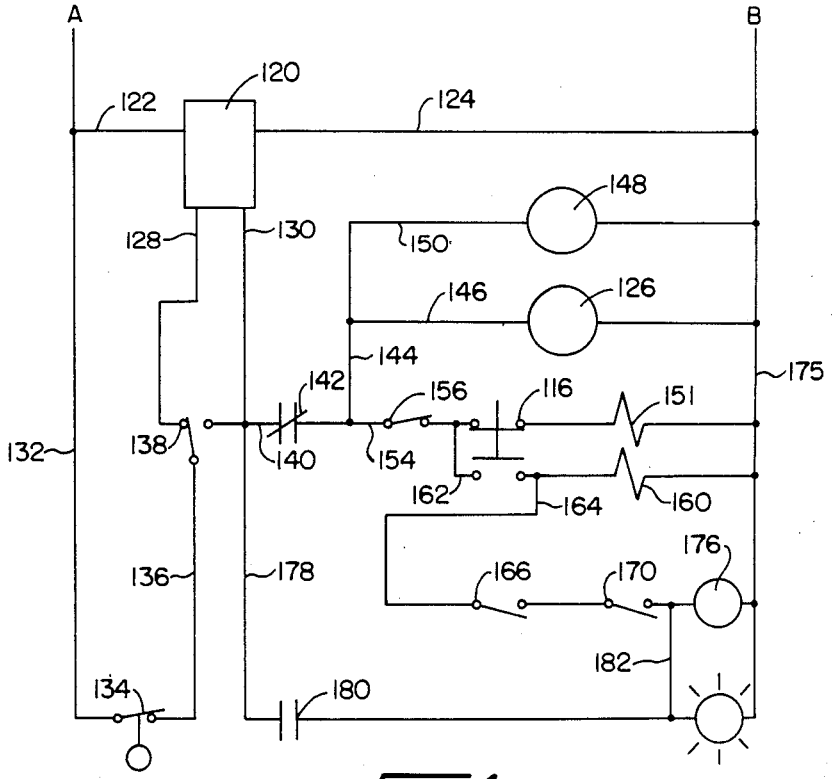
FIG. 4 is an electrical schematic of the pump off detection system of the invention.

The pump off detection system of the instant invention may be best understood by referring to FIGS. 1 and 4. Lines A and B provide 120 volts of single phase AC power to a timer 120 through lines 122 and 124. Timer 120 may be set to cause continuous or cyclical operation of an electric motor 126 which operates the cross center variable displacement pump 30. This pump 30 provides working fluid to hydraulic cylinders 16 and 18. When timer 120 is set to activate electric motor 126, lines 128 and 130 at its output are connected electrically. It may be observed that line A is connected through line 132, switch 134, line 136 and switch 138 to line 128. Switch 134 is a float switch mounted in the hydraulic fluid reservoir R in enclosure 32 and remains closed so long as there is adequate fluid in the hydraulic system. Power is provided to motor 126 through line 128, timer 120, line 130, line 140, which contains a pair of normally closed relay contacts 142, line 144 and line 146. An hour meter 148, which records the time motor 126 is operated, is connected in parallel with motor 126 and receives power through lines 144 and 150. The circuit shown in FIG. 4 also eneregizes the windings of solenoids 151 and 160 which operate a solenoid driven valve 152, shown in FIG. 5, to cause the hydraulic motor 30, which supplies working pressure fluid to cylinders 16 and 18 to move from one side of center to the other side of center to reverse the flow of working fluid between the pump and the cylinders. The winding of 151 which operates solenoid valve 152 to cause piston rods 20 and 22 and raise yoke plate 24, is enabled through line 142, and line 154 which contains jog switch 156, when the contacts 116 of limit switch 112 have been moved to the position shown by cam 114 on traveling rod 110. Solenoid winding 160 operates valve 152 to cause the hydraulic motor to be stroked across center to cause the pump to remove working pressure fluid from the cylinders 16 and 18 at a controlled rate. This permits the pistons 20 and 22 and, yoke plate 24, to move downwardly under the weight of rod string 90. The winding of solenoid 160 is enabled and energized through line 142, line 154 which contains jog switch 156, and line 162 when the contacts 116 of limit switch 112 have been moved to the alternate position by cam 108 on traveling rod 110.

A line 164 which is connected between line 162 and power line B, contains the contacts 166 of a second limit switch 168, the contacts 170 of a pressure switch 172 and a relay coil 176. FIG. 1 shows that limit switch 168 is mounted on cylinder 18 and is actuated by cam 108 on travelling rod 110, while pressure switch 172 is mounted for response to fluid pressure within conduit 34. Returning to FIG. 4, line 178, which contains a pair of normally open relay contacts 180, is connected between line 142 and line B which connects to line 164 between pressure switch contacts 170 and relay coil 176. FIG. 1 further shows that the contacts 166 of limit switch 168 are closed when cam 108 on traveling rod 110 engages the switch 168 as it is travelling downwardly. Switch 168 is positioned such that it is engaged by cam 108 shortly after the latter has moved downwardly a distance equal to that which yoke plate 24 must travel to accomodate the contraction of rod string 90. In other words, cam 108 engages limit switch 168 to cause contacts 166 to close shortly after yoke plate 24 has traveled approximately ten to fifteen inches. In should be noted that the contacts of limit switch 168 can only be closed during downward travel of yoke plate 24.

Pressure switch 172 senses the pressure of the working fluid in hydraulic cylinders 16 and 18. Switch 172 is adjusted such that contacts 170 are closed when that pressure is greater than it would be if the weight of the fluid column in tubing string 52 were supported by tubing string 52. Consequently, if the contacts 170 of pressure switch 172 are closed, indicating that the rod string 90 is supporting the fluid column in tubing string 52, and the contacts 166 of switch 168 simultaneously are closed, a pumped off condition is indicated and relay coil 176 is energized. When coil 176 is energized, the normally closed relay contacts 142 are opened to interrupt power to the motor 126 and the normally open relay contacts 180 are closed supply power to hold in the relay coil 176. The circuit will remain in this state until timer 120 breaks the electrical contact between lines 128 and 130. When power to line 130 is interrupted, relay coil 176 is deenergized, normally closed relay contacts 142 close and the normally open relay contacts 180 open. This enables power to be restored to the motor 126. From this it may be seen that the pump off detection system of the instant invention will immediately disable the electric motor 126 which provides power to the hydraulic motor 30 and thereby deactivate hydraulic stroking device 10 when well 14 becomes pumped off.

It has been discovered that pump off of gas-oil wells may be substantially reduced if conventional long cycles of alternately pumping and shutting in a well are replaced by cycles of alternate short periods of pumping and outgassing the well. Normally wells are pumped for a period of time not less than several hours. If a well is in a pumped off status at such time that it has been "shut in", it may require one to three hours merely to fill the tubing string. Usually after several more hours of pumping the well is again pumped off and production stops. It has been found that cycles of alternately pumping and outgassing a well for short period, greatly reduces well pump off. A typical cycle which has been found to be effective in preventing well pump off includes 30 minutes of pumping followed by 15 minutes of outgassing.

Although it is known that outgassing a well to reduce back pressure will increase the flow of formation fluid into the well, it is also known that such a reduced back pressure promotes gas lock of a down hole pump. It has been theorized that utilization of the aforementioned cycles of alternate pumping and outgassing for short periods obtains the advantage of a reduced back pressure in the casing but not the disadvantage. It is believed that outgassing the well decreases the back pressure in the casing and causes increased amounts of formation fluid to flow into the well. However, since the outgassing period is relatively short and since outgassing does not occur during pumping it is believed that sufficient back pressure is built up during pumping to prevent gas lock. Further, it is thought that the relatively short pumping cycle may not provide sufficient time for gas lock to occur.

Applying the aforementioned stroking and outgassing system to a well readily may be accomplished easily utilizing a hydraulic stroking device 10 as described above. Looking to FIG. 5, it may be seen that motor 126 drives variable displacement across center pump 30 which supplies working pressure fluid through conduit 190 and a diverter valve 192 to fluid conduit 34 to operate pistons 20 and 22 and cylinders 16 and 18 respectively as mentioned above. Furthermore, limit switch 112 operates solenoid 151 to move the displacement control of hydraulic pump 30 from a position of maximum fluid displacement in one direction across center to a position of maximum fluid displacement in the opposite direction. Solenoid valve 152 directs pilot fluid in line 194 to one end of a cylinder 196 to move a piston 198 connected to the displacement control of pump 130 to one extreme position and directs pressure fluid in line 194 to the opposite end of cylinder 196 to move piston 198 to the other extreme position. A working pressure relief valve 202 is connected to conduit 190 and a pilot pressure relief valve 204 is connected to pilot line 194. It may be appreciated that diverter valve 192 is not utilized for conventional pumping or with the previously mentioned pump off detection system.

Figure 5:
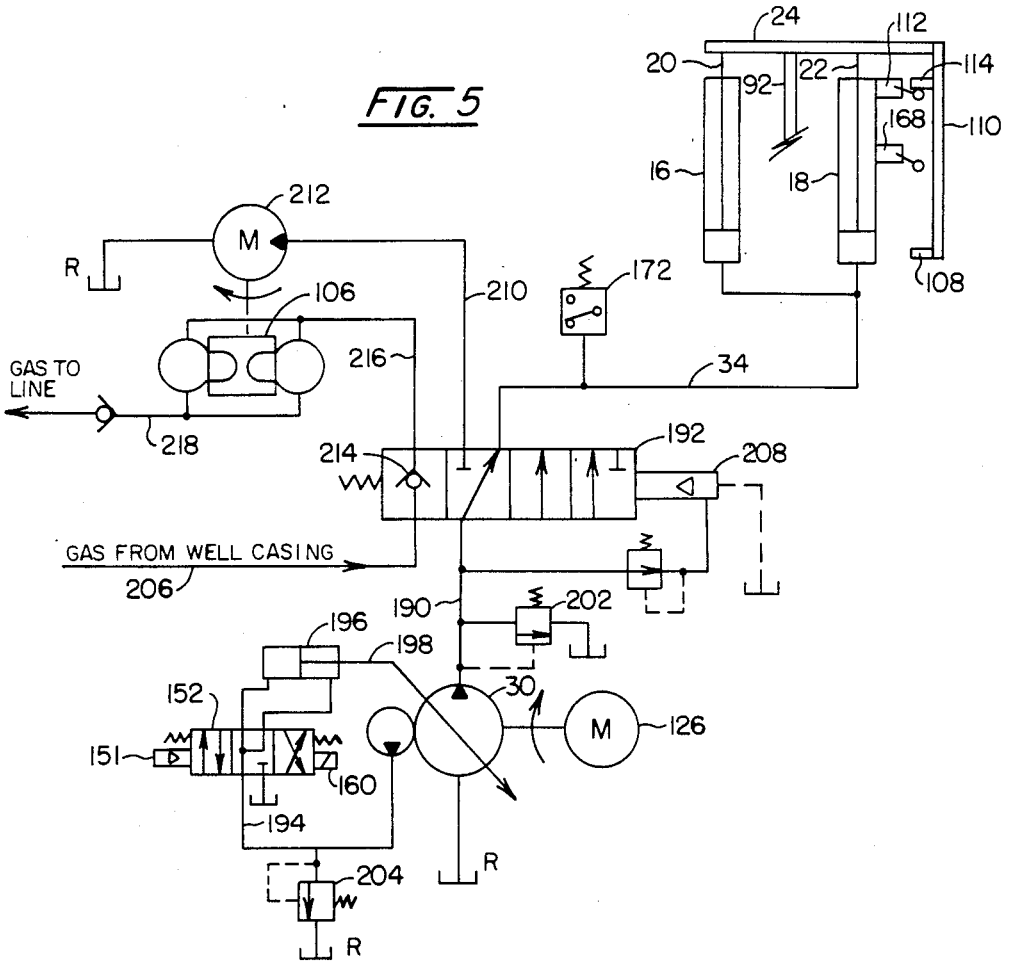
FIG. 5 is a hydraulic schematic of the control of the outgassing device and suface stroking device of the invention.

During pumping, diverter valve 192 is in the position shown. In this position hydraulic pump 30 is connected through conduit 190 and valve 192 to fluid conduit 34 as previously mentioned. Outgassing device 106 (FIG. 1) is shown connected to the inside of well casing 40 through fluid conduits 206 and 216 and valve 192. During the pumping portion of the cycle, conduit 206 is blocked such that gas cannot flow from well 14. This is intended to permit the back pressure in the casing to increase during the pumping operation such that gas lock is prevented. At the end of the pumping portion of the cycle solenoid winding 151 is energized to operate solenoid valve 152 such that working pressure fluid is output from pump 30 into conduit 190 and solenoid 208 is operated to move diverter valve 192 to the alternate position. In this position the fluid conduit 34 to pistons 20 and 22 is blocked and working pressure fluid in conduit 190 from pump 30 is connected through valve 192 and conduit 210 to a hydraulic motor 212 which drives outgassing device 106. At the same time a ball valve 214 is unseated which connects gas conduit 206 with conduit 216 connected to the inlet of outgassing device 106. In FIG. 5 outgassing device 106 is represented as being a compressor, the input of which is utilized to develop vacuum and which has an outlet at line 218 in fluid communication with a gas sales line. Of course, outgassing device 106 could be a suction pump or any other device which removes gas from well 14 and lowers the back pressure in the well.

At the conclusion of the outgassing period, solenoid 208 is operated to move diverter valve 192 to the alternate position in which the output of hydraulic pump 30 at fluid conduit 190 is in fluid communication with conduit 34 which is connected to hydraulic cylinders 16 and 18. In this position of valve 192, fluid conduit 216 to hydraulic motor 212 is blocked and ball check valve 214 is seated to close off gas conduit 206. This permits the back pressure in well 14 to rise during the pumping period as described above.

It has been found that the cycle of alternate short periods of pumping and outgassing is suitable particularly for small stripper wells located in rural communities. In these areas the electrical power supplied to the wells normally is 110 volts AC single phase. This limits the maximum size of motor which can be utilized to operate the well to about 10 horsepower. Typically, a ten horsepower motor would be required to operate a surface stroking unit and a 5 horsepower motor would be required to operate an outgassing device such as a compressor. With the pumping and outgassing system of the instant invention, a single 10 horsepower motor is all that is required for both pumping and outgassing since these operations are not carried out simultaneously.

Figure 6:
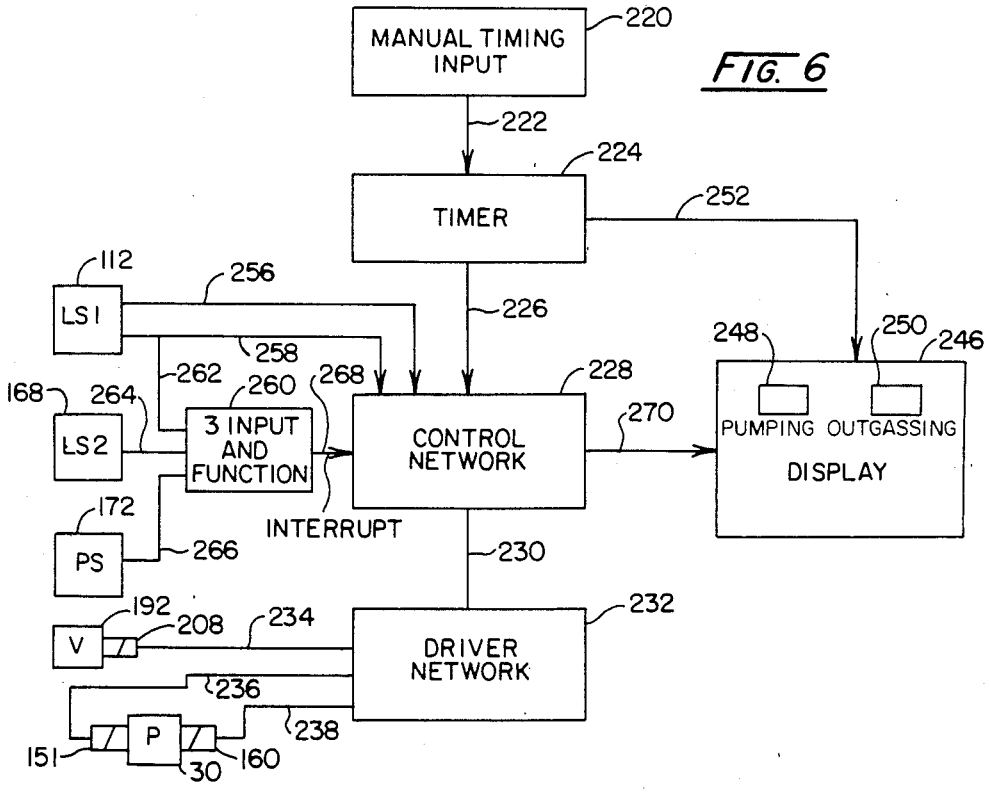
FIG. 6 is a block diagram which generally illustrates the circuit of the control for the operation of the surface stroking device in conjunction with the outgassing device and pump off detection system of the instant invention.

Although the short cycle pumping and outgassing system may be operated without a pump off detection device, well production will be enhanced if such a device is incorporated within the system. A block diagram of the circuit required to integrate the pump off detection system with the pumping and outgassing system may be seen by referring to FIG. 6. In FIG. 6 functions corresponding with those described in connection with FIGS. 4 and 5 will be identified with the same numerals. It should be mentioned that, whereas the pump off detection circuit described in FIG. 4 deactivates the electric motor 126 which operates the variable displacement cross center pump 30 which provides power to the hydraulic circuit, the pump off detection device does not deactivate electric motor 126 when used in conjunction with the pumping and outgassing system. In that system electric motor 126 drives pump 30 at all times. Power to motor 126 is interrupted only when reservoir switch 134 opens because there is insufficient fluid in the hydraulic system.

A manual timing input device represented at block 220 is provided for setting the time periods of the pumping operation and the outgassing operation. Provided, for example as a key pad, the timing input function has an output 222 which is directed to the input of a timer represented at block 224. Timer 224 times out the preset time periods of the pumping and outgassing operations and has an output at line 226 which is directed to the input of a control network represented at block 228. Control network 228 determines whether the system is to be pumping or outgassing and provides an appropriate output at line 230 to a driver network represented at block 232. Network 232 energizes the winding of solenoid 208 at appropriate levels to move diverter valve 192 to proper operating positions and energizes the windings of solenoids 151 and 160 of solenoid valve 152 to set the displacement control of pump 30 through 236 and 238. A display represented at block 246 contains digital readouts, respectively indicating the minutes remaining for any given outgassing cycle and pumping cycle. The displays may be provided, for example, as multi-segment LEDs or liquid crystal devices. Display 246 receives outputs from timer 224 as represented by line 252.

Limit switch 112 provides an output at line 256 to control network 228 when solenoid 151 must be activated to move the displacement control of hydraulic pump 30 to the side of center where working pressure fluid is output to conduit 190. A corresponding output of switch 112 is provided to control network 228 at line 258 when solenoid 160 must be operated to move the displacement control of pump 30 such that working pressure fluid is removed from fluid conduit 190. Network 228 operates solenoids 151 and 160 through driver network 232 as mentioned previously. It may be observed that the output of limit switch 112 at line 258, which calls for setting the displacement control of pump 30 for downward movement of stroking piston 16 and 18, is directed to the input of a 3 input AND function identified by block 260 via line 262. An enabling output occurs at lines 258 during downward movement of pistons 20 and 22. Similarly, the output of limit switch 168 is directed to the input of AND function 260 through line 264. It may be recalled that limit switch 168 is set to detect when stroking cylinders 16 and 18 have moved downwardly from an upward terminal position a distace sufficient to accomodate the release of strain from the rod string 90 when the load of the fluid column in the tubing string 52 is transferred from the rod string to the tubing string. Limit switch 168 outputs an enabling signal at line 264 when pistons 16 and 18 and yoke plate 24 have reached this position. The output of pressure switch 172 is directed to the third input of AND function 260 through line 266. Switch 172 provides an enabling output at line 266 when the pressure of the working fluid in stroking cylinders 20 and 22 exceeds the pressure which should be present providing the rod string is not supporting the fluid column in the tubing string. Consequently, if as pistons 16 and 18 move downwardly past the position detected by limit switch 168 and the pressure in cylinders 20 and 22 exceeds that pressure which should be present if the pistons are not supporting the fluid column, a pump off condition obtains and the three inputs at lines 262, 264, and 266 to and gate 260 are enabled. When this occurs an interrupt signal is output from the AND function represented by block 260 through line 268 to the input of the control network represented at line 228. When this occurs control network outputs a signal at line 230 to driver network 232 which shifts diverter valve 192 to cause the pumping operation to be interrupted and the outgassing operation to be initiated. It has been found preferable to have the outgassing operation continue for the remainder of the pumping operation time period and for the entire time period of the outgassing operation. At the conclusion of the outgassing operation the pumping operation is again initiated. When control network 228 receives a pump off interrupt from the and gate represented at block 260 it outputs a signal at line 270 to display 246.

It should be apparent that the circuit depicted in block diagramatic style in FIG. 6 provides advantageous flexibility in selecting the time periods of the pumping operation and the outgassing operation, as well as for the conditions detecting a well pump off condition.

From the above it may be seen that a unique method and system for detecting pump off of a gas-oil well and for increasing the flow of formation flow into the well to reduce the occurrence of pump off is provided.

Since certain changes may be made to the above-described system, method, and apparatus without departing from the scope of the invention herein, it is intended that all matter contained in the description thereof or shown in the accompanying drawings shall be interpreted as illustrative and not in a limiting sense.

I claim:

1. In a gas-oil production system for pumping formation fluid in a well through a tubing string within which a down hole pump connected to a hydraulic stroking device through a rod string is provided said pump including a plunger reciprocally driven by said hydraulic stroking device toward an upper terminal position during a plunger upstroke wherein said rod string normally supports the weight of a column of fluid and toward a lower terminal position at the end of a plunger downstroke during which said weight of said column fluid is normally transferred to said tubing string through fluid within said pump, the method for detecting when said well is pumped off which comprises the steps of:

supplying working fluid to said hydraulic stroking device to raise said hydraulic stroking device and thereby move said plunger from said lower terminal position to said upper terminal position;

removing said working fluid at a controlled rate from said hydraulic stroking device to cause downward movement of said hydraulic stroking device and thereby cause said rod string and said plunger to be lowered in said tubing string until said plunger is at said lower terminal position;

sensing the pressure of the working fluid when said plunger reaches a predetermined position during said downstroke which corresponds with said normal transfer of said weight of said column of fluid;

comparing said sensed pressure with a predetermined threshold pressure corresponding with such pressure occurring when said normal transfer of said weight of said column of fluid has occurred; and actuating a control device to effect the deactivation of said hydraulic stroking device when said comparison determines that said sensed pressure is above said threshold.

2. The method of claim 1 wherein said actuation of said control device deactivates said hydraulic stroking device for a select period of time, following which said device is activated.

3. The method of claim 1 wherein said predetermined position is selected to correspond with a location along the downward movement of said hydraulic stroking device where the strain relief contraction of said rod string is completed.

4. In a gas-oil well production system for pumping formation fluid in a well casing through a tubing string within which a down hole pump connected to a hydraulic stroking device through a rod string is provided, said pump including a plunger reciprocally driven by said hydraulic stroking device toward an upper terminal position during a plunger upstroke wherein said rod string normally supports the weight of a column of fluid and lower terminal position at the end of plunger downstroke during which said weight of said column of fluid is normally transferred to said tubing string through fluid within said pump, an outgassing device in fluid communication with said well casing, the method for operating said hydraulic stroking device and said outgassing device which comprises the steps of:

enabling said hydraulic stroking device while disabling said outgassing device for a first time period;

supplying working fluid to said enabled hydraulic stroking device to raise said stroking device and thereby move said plunger from said lower terminal position to said upper terminal position;

removing said working fluid at a controlled rate from said hydraulic stroking device to cause downward movement of said hydraulic stroking device and thereby cause said rod string and said plunger to be lowered in said tubing string until said plunger is at said lower terminal position;

sensing the pressure of the working fluid when said plunger reaches a predetermined position during said downstroke which corresponds with said normal transfer of said weight of said column of fluid;

comparing said sensed pressure with a predetermined threshold pressure corresponding with such pressure occurring when a said normal transfer of said weight of said column of fluid has occured;

normally enabling said outgassing device while disabling said hydraulic stroking device for a second time period following said first time period to thereby reduce the gas pressure in said well casing;

detecting a pump off condition when said sensed pressure is above said thresold pressure; and enabling said outgassing device while disabling said hydraulic stroking device in response to said detected pump off condition.

5. The method of claim 4 wherein said outgassing means is enabled for the remainder of said first time period when said pump off condition is detected.

6. The method of claim 4 wherein said first time period is longer than said second time period.

7. In a gas-oil well installation of a variety in which a tubing string within a casing extend into a well and a hydraulic stroking device is actuated for reciprocatively effecting actuation of the plunger of a down hole pump to provide uptroke and downstroke movement thereof by alternately supplying and removing working fluid to a piston drive coupled by a rod string to said plunger, and wherein said rod string normally supports the weight of a column of fluid during said upstroke and said weight of said column of fluid normally is transferred to said tubing string through fluid within said pump, the improved control system comprising:

position sensor means for sensing the orientation of said stroking device when said plunger reaches a predetermined position during said downstroke which corresponds with said normal transfer of said weight of said column of fluid for providing a first sensing condition;

outgassing means connected in gas fluid communication with said well casing and actuable to draw gas therefrom;

pressure sensing means responive to said working fluid pressure and having a second sensing condition when said sensed pressure is above working fluid pressure corresponding with that exhibited at said normal transfer of said weight of said column of fluid; and control means including timing means for effecting the actuation of said hydraulic stroking device for a predetermined first interval and then to actuate said outgassing means for a predetermined second interval;

said control means being responsive in the simultaneous presence of said first and second sensing conditions to halt said hydraulic stroking device actuation and actuate said outgassing means.

8. The improved control system of claim 7 in which said position sensor means is a cam actuated switch mounted for actuation by said hydraulic stroking device during said downward movement at said predetermined position.

9. The improved control system of claim 7 in which said pressure sensing means is a pressure sensitive switch responsive to a pressure of said working fluid exceeding a predetermined threshold pressure.

10. The improved control system of claim 9 including:

limit switch means actuable by said hydraulic stroking device at the terminus of said upstroke to provide a downstroke switch condition; and said control means is responsive to the simultaneous presence of said downstroke and said first and second switching conditions to effect said altering of said actuation.

11. The improved control system of claim 7 in which said control means is responsive in the simultaneous presence of said first and second sensing conditions to actuate said outgassing means for the remainder of said first interval as well as for said subsequent second interval.

12. The improved control system of claim 7 in which the sum of said first and second intervals is less than one hour.

13. The improved control system of claim 12 in which said first interval is greater than said second interval.

* * * * *